US008100134B2

(12) United States Patent
Meyer et al.

(10) Patent No.: US 8,100,134 B2
(45) Date of Patent: Jan. 24, 2012

(54) VENTILATED SMOKING ARTICLE

(75) Inventors: Cédric Meyer, Aran (CH); Antoun Frédéric, Cressier (CH); Charles Kuersteiner, Jouxtens-Mézery (CH)

(73) Assignee: Philip Morris USA Inc., Richmond, VA (US)

( * ) Notice: Subject to any disclaimer, the term of this patent is extended or adjusted under 35 U.S.C. 154(b) by 708 days.

(21) Appl. No.: 11/709,204

(22) Filed: Feb. 22, 2007

(65) Prior Publication Data

US 2007/0267034 A1 Nov. 22, 2007

(30) Foreign Application Priority Data

Feb. 22, 2006 (EP) ..... 06250945

(51) Int. Cl.
*A24D 3/00* (2006.01)

(52) U.S. Cl. ..... 131/336; 131/330; 131/339; 131/361; 131/365

(58) Field of Classification Search ..... 131/360, 131/336, 339, 361, 365
See application file for complete search history.

(56) References Cited

U.S. PATENT DOCUMENTS

| | | | | |
|---|---|---|---|---|
| 4,498,487 | A * | 2/1985 | Frattolillo | 131/336 |
| 4,582,071 | A * | 4/1986 | Westcott et al. | 131/336 |
| 4,687,009 | A * | 8/1987 | Nichols | 131/336 |
| 2005/0000526 | A1 * | 1/2005 | Tarora et al. | 131/200 |

FOREIGN PATENT DOCUMENTS

| | | |
|---|---|---|
| EP | 1 535 524 A1 | 6/2005 |
| GB | 864247 | 3/1961 |

OTHER PUBLICATIONS

International Search Report and Written Opinion dated Jan. 15, 2008 for PCT/IB2007/002352.
International Preliminary Report on Patentability dated Aug. 26, 2008 for PCT/I132007/002352.
European Search Report for EP 06250945.01 dated Sep. 11, 2006.

* cited by examiner

*Primary Examiner* — Khanh P Nguyen
*Assistant Examiner* — Margaret Squalls
(74) *Attorney, Agent, or Firm* — Buchanan Ingersoll & Rooney PC

(57) ABSTRACT

A cigarette includes a rod comprising a wrapped tobacco column that is joined to an axially aligned filter by a band of air impermeable tipping paper. The filter end of the rod is inserted into a mouthpiece having an air impermeable outer surface that comprises a ventilation tube and a second filter, separated by a mixing chamber. The ventilation tube has an air permeable annular wall that defines a central axial passage through which the rod extends. In use, the end surface of the annular wall at the rod end of the ventilation tube, which extends radially outward around the rod, acts as a ventilation surface through which air is drawn into the mixing chamber, where it mixes with mainstream smoke from the burning tobacco rod. The air/smoke mixture is drawn through the second filter into the consumer's mouth.

14 Claims, 3 Drawing Sheets

VENTILATED SMOKING ARTICLE

CROSS REFERENCE TO RELATED APPLICATION

This application claims priority under 35 U.S.C. §119 to European Application No. 06250945.0, filed Feb. 22, 2006, the entire content of which is hereby incorporated by reference.

The present invention relates to a ventilated smoking article having a mouthpiece comprising a ventilation tube and a mixing chamber.

Smoking articles, such as cigarettes, commonly include a charge of smokable material, for example shredded tobacco, surrounded by a paper wrapper to form a rod of smokable material. In filter cigarettes, a filter element, composed of filter material wrapped by a wrapper known as a plug wrap, is typically attached to one end of the rod of shredded tobacco by means of a wrapping or tipping material.

To reduce the delivery of certain combustion products, such as total particulate matter (TPM) and carbon monoxide, it is well known to provide ventilated filter cigarettes in which provision is made for admission of ambient air to dilute the mainstream smoke drawn by the smoker. Conventionally, ventilation is effected through ventilation holes provided in the filter surface, the tipping material and the plug wrap. It has been suggested that in such ventilated filter cigarettes there is a risk of a smoker varying the delivery of the cigarette by inadvertently covering the ventilation holes. It is therefore desirable to provide ventilated cigarettes or other smoking articles in which this risk is reduced or eliminated.

According to the present invention there is provided a ventilated smoking article comprising: a rod comprising: a column of smokable material circumscribed by an air permeable wrapper; and a mouthpiece with an air impermeable outer surface, the mouthpiece comprising: a ventilation tube; and a mixing chamber downstream of the ventilation tube, the ventilation tube having an annular air permeable wall that defines a passage in which an end portion of the rod is received, the rod extending from a rod end of the ventilation tube, the end surface of the annular wall at the rod end of the ventilation tube extending radially outward around the rod and being in fluid communication with the mixing chamber, wherein the interface between the annular wall of the ventilation tube and the outer surface of the end portion of the rod received in the passage is air impermeable.

In use, the consumer puts his lips around the mouthpiece of a lit smoking article according to the invention drawing mainstream smoke diluted with ambient ventilating air. The ambient ventilating air flows from the end surface of the annular wall at the rod end of the ventilation tube, through the air permeable annular wall and the end surface of the annular wall at an opposed mouth end of the ventilation tube, into the mixing chamber located in the mouthpiece of the smoking article where it mixes with mainstream smoke drawn through the rod by the consumer. The end surface of the annular wall at the rod end of the ventilation tube thus acts as a ventilation surface through which air is drawn into the mixing chamber, where it mixes with mainstream smoke from the burning column of smokable material.

The interface between the ventilation tube and the rod is rendered air impermeable by making the inner surface of the wall of the ventilation tube or the outer surface of the end portion of the rod received in the axial passage of the ventilation tube air impermeable, or by making both the inner surface of the wall of the ventilation tube and the outer surface of the end portion of the rod received in the axial passage of the ventilation tube air impermeable.

The air impermeable interface between the outer surface of the end portion of the rod and the inner surface of the annular air permeable wall of the ventilation tube prevents lateral ingress of ventilating air from the ventilation tube into the rod and thereby creates two distinct pressure drops, one for the ventilation tube and another for the rod. The creation of two distinct pressure drops not only ensures the stability of the ventilation created through the ventilation tube as the smoking article is combusted, but also facilitates the design of smoking articles according to the invention having different deliveries, for example different tar and/or nicotine levels.

Preferably, the outer surface of at least the end portion of the rod received in the passage of the ventilation tube is air impermeable. More preferably, the outer surface of the end portion of the rod received in the passage of the ventilation tube and the outer surface of a portion of the rod extending from the rod end of the ventilation tube, adjacent to the mouthpiece, is air impermeable. Preferably, the outer surface of between about 5 mm and about 12 mm, more preferably of at least 9 mm, of the rod extending from the rod end of the ventilation tube is air impermeable.

The outer surface of the rod may be rendered air impermeable using suitable means and materials. Preferably, the outer surface of the rod is rendered air impermeable air by attaching an air impermeable material, such as a commercially available air impermeable tipping material, to the outer surface of the rod.

It is desirable that when a smoking article according to the invention is smoked, the mouthpiece and, in particular, the ventilation tube does not burn or smoulder. Rendering the outer surface of not only the end portion of the rod received in the passage, but also the outer surface of a portion of the rod extending from the rod end of the ventilation tube air impermeable advantageously prevents combustion of the smoking article beyond this limit.

Smoking articles according to the invention may also be made self extinguishing through, for example, the provision of a separate annular non-combustible band of between about 3 mm and about 5 mm in width, located at a suitable distance from the rod end of the ventilation tube. Alternatively, a mark may be provided at a suitable distance from the ventilation tube on the wrapper circumscribing the column of smokable material to indicate to the consumer that the smoking article should be extinguished at that point.

In preferred smoking articles according to the present invention, the rod further comprises a filter element affixed to one end of the column of smokable material at the mouth end of the rod. The inclusion of a filter element at the mouth end of the column of smokable material advantageously enables the overall resistance to draw (RTD) of the rod to be adjusted to a desired value through variation of the RTD of the filter element, without altering the RTD of the column of smokable material. Adjusting or tuning the RTD of the rod relative to the RTD of the ventilation tube in this manner, enables a smoking article according to the invention having a desired ventilation, delivery and RTD to be achieved without, for example, changing the tobacco density or length of the column of smokable material.

The filter element may include one or more filter segments. The filter element may, for example, comprise cellulose acetate, paper or any other filter material suitable for use in smoking articles; it may also comprise charcoal or other absorbents, and it may contain flavourants or other smoke modifiers, such as smoke constituent reducing agents. In other embodiments, the filter element provided at the end of the wrapped column of smokable material may be replaced by an element that serves simply as an extension to the rod and, in use, has little if any filtration effect on mainstream smoke drawn through the column of smokable material by the consumer. On the other hand, extra filter material may be included at the mouth end of the rod if it is desired to achieve a low to very low tar delivery (FTC tar).

Preferably, the filter element is circumferentially surrounded by air impermeable material, more preferably air impermeable tipping material that overlaps a portion of the wrapped column of smokable material adjacent to the filter element to fasten the filter element to the wrapped column of smokable material. Preferably, the portion of the wrapped column of smokable material adjacent to the filter element overlapped by the air impermeable material is between about 5 mm and about 18 mm in length.

Preferably, the external diameter of the filter element is generally equal to the external diameter of the wrapped column of smokable material.

Preferably, the rod and the ventilation tube each are of substantially uniform circular cross-section, the outer diameter of the ventilation tube being greater than the outer diameter of the rod.

Preferably, the rod has an external diameter of between about 4 mm and about 7.5 mm, more preferably of between about 5.4 mm and about 7.5 mm.

Preferably, the ventilation tube has an external diameter of between about 5 mm and about 8.5 mm, more preferably of between about 6 mm and about 8.5 mm.

Preferably the difference between the external diameter of the ventilation tube and the external diameter of the rod is at least about 2.5 mm, so that the wall of the ventilation tube is at least about 1.25 mm thick.

The increased diameter of the ventilation tube and hence mouthpiece of a cigarette or other smoking article according to the invention compared to the rod thereof, makes smoking articles according to the invention particularly suited to the inclusion of columns of tobacco or other smokable material of smaller than standard diameter. Smoking articles according to the present invention allow a smoker to achieve a very good grip on cigarettes having a tobacco column with a small diameter, such as slim and ultra slim cigarettes, as the mouthpiece may be of standard cigarette diameter, which some smokers may find easier to grip comfortably than a very slim cigarette.

Preferably, the length of the mouthpiece is between about 25 mm and about 45 mm, more preferably between about 25 mm and about 34 mm, most preferably about 32 mm.

Preferably, the length of the ventilation tube is between about 8 mm and about 37 mm, most preferably about 15 mm.

Preferably, the length of the mixing chamber is between about 2 mm and about 10 mm.

Preferred smoking articles according to the invention are between about 85 mm and 130 mm in length, more preferably about 102 mm in length.

Preferably, the length of the rod is between about 75 mm and about 85 mm.

Preferably, the length of the column of smokable material is between about 70 mm and about 85 mm.

Preferably, the end portion of the rod received in the passage is between about 5 mm and about 37 mm in length, more preferably between about 8 mm and about 15 mm in length.

Preferably, the rod comprises a column of tobacco cut filler wrapped in cigarette paper.

In one preferred embodiment, the rod extends through the whole length of the ventilation tube. In this case, in use, the air impermeable interface between the outer surface of the rod extending through the ventilation tube and the annular wall thereof prevents the ventilation airflow, which is parallel to the flow of mainstream smoke through the rod, from mixing with the mainstream smoke until they reach the mixing chamber.

In other preferred embodiments, the rod extends only partially through the length of the ventilation tube. Where the rod extends only partially through the length of the ventilation tube, the interface between the passage downstream of the rod and the annular wall of the ventilation tube may be air permeable. In this case, in use, the ventilation airflow may mix with mainstream smoke drawn through the rod in this 'empty' portion of the passage downstream of the rod as well as in the mixing chamber.

A particularly preferred smoking article of the present invention is a cigarette comprising a tobacco column attached to a first filter element and a mouthpiece comprising a ventilation tube, a mixing chamber and a second filter element.

The ventilation tube and the axial passage therein are preferably designed to retain a specific rod by a friction fit. Retention of the rod may be ensured by additional means, such as a fine line of adhesive parallel to the axial passage.

In smoking articles according to the present invention, the end surface of the annular wall at the rod end of the ventilation tube is air permeable across substantially its entire surface. In use, this advantageously ensures even pressure distribution and resistance to draw across the ventilation tube.

In a ventilation tube having an annular wall formed from an air impermeable material in which one or more discrete, spaced apart channels are provided, the end surfaces of the annular wall are, in contrast, not air permeable across substantially their entire surface.

In smoking articles according to the present invention the wall of the ventilation tube is preferably of substantially uniform density.

Preferably, the wall of the ventilation tube is made of an air permeable material approved for use in food by an appropriate regulatory authority.

Preferably, the wall of the ventilation tube is made from an air permeable and inherently porous material; for example, it may be made of a porous thermoplastic material. Alternatively, the wall of the ventilation tube may be composed of or formed from sintered metal, steel mesh, ceramic materials, heat treated cellulose acetate, non-woven materials, or fibrous materials, for example bi-component, continuous or stable fibre media made by an extrusion or pultrusion process.

A preferred material to form the wall of the ventilation tube is a thermoplastic material, more preferably a sinterable thermoplastic material. A preferred thermoplastic material to make the wall of the ventilation tube is a polyolefin, including, but not limited to, ethylene vinyl acetate (EVA); ethylene methyl acrylate (EMA), polyethylenes, polypropylenes, ethylene-propylene rubbers, ethylene-propylenediene rubbers, polystyrene, and mixtures and derivatives thereof. A particularly preferred polyolefin is a polyethylene. Examples of suitable polyethylenes include low density polyethylene (LDPE), linear low density polyethylene (LLDPE), high density polyethylene (HDPE), ultra-high molecular weight polyethylene (UHMWPE), and derivatives thereof.

Porous thermoplastic materials suitable for use in forming the wall of the ventilation tube of smoking articles of the present invention are known in the art and readily commercially available. For example, an inherently porous high density polyethylene (HDPE), coarse type, suitable for use in forming a ventilation tube of the present invention is obtainable from POREX® Porous Product Group, Germany. If desired, the porous thermoplastic materials may further comprise additives such as lubricants, fillers or colorants. Advantageously, the ventilation tube is moulded from a sintered porous thermoplastic material in one continuous and contiguous piece.

Preferably, the average pore size (diameter) of the porous material used to make the tube is at least about 10 μm, preferably in the range of about 50 μm to about 300 μm. Advantageously, the average pore volume or average void volume, that is the average ratio of the air volume of the porous material to the total volume of the said material, is between about 40% and about 60%.

In preferred embodiments of the present invention, the mouthpiece further comprises a filter element downstream of the mixing chamber. Where the mouthpiece comprises such a filter element, the filter element may include one or more filter segments. The filter element may, for example, comprise cellulose acetate, paper or any other filter material suitable for use in smoking articles; it may also comprise charcoal or other absorbents, and it may contain flavourants or other smoke modifiers, such as smoke constituent reducing agents. Alternatively or in addition to the filter element, the mouthpiece may further comprise a cap or cover element that closes off the mouth end of the mouthpiece, but which has little filtration effect.

According to the present invention the outer surface of the mouthpiece is air impermeable. The outer surface may be rendered air impermeable using suitable means and materials. Preferably, air impermeability of the outer surface is achieved by attaching an air impermeable material, such as a commercially available air impermeable tipping material or rigid softboard, to the outer surface of the wall of the ventilation tube and, where present, the outer surface of the filter element such that it entirely covers the outer surface of the mouthpiece and renders this surface air impermeable. The air impermeable tipping paper must have a porosity of equal to or less than 5 $cm^3/min.cm^2$ as measured in accordance with ISO method 2965. Preferably, the air impermeable tipping material is attached to the outer surface of the wall of the ventilation tube and, where present, the outer surface of the filter element using a suitable adhesive such as glue.

The invention will now be illustrated, by way of example only, with reference to the accompanying drawings, in which.

The embodiments of cigarettes shown in the drawings have several components in common; these have been given the same reference numerals throughout.

Figure 1:
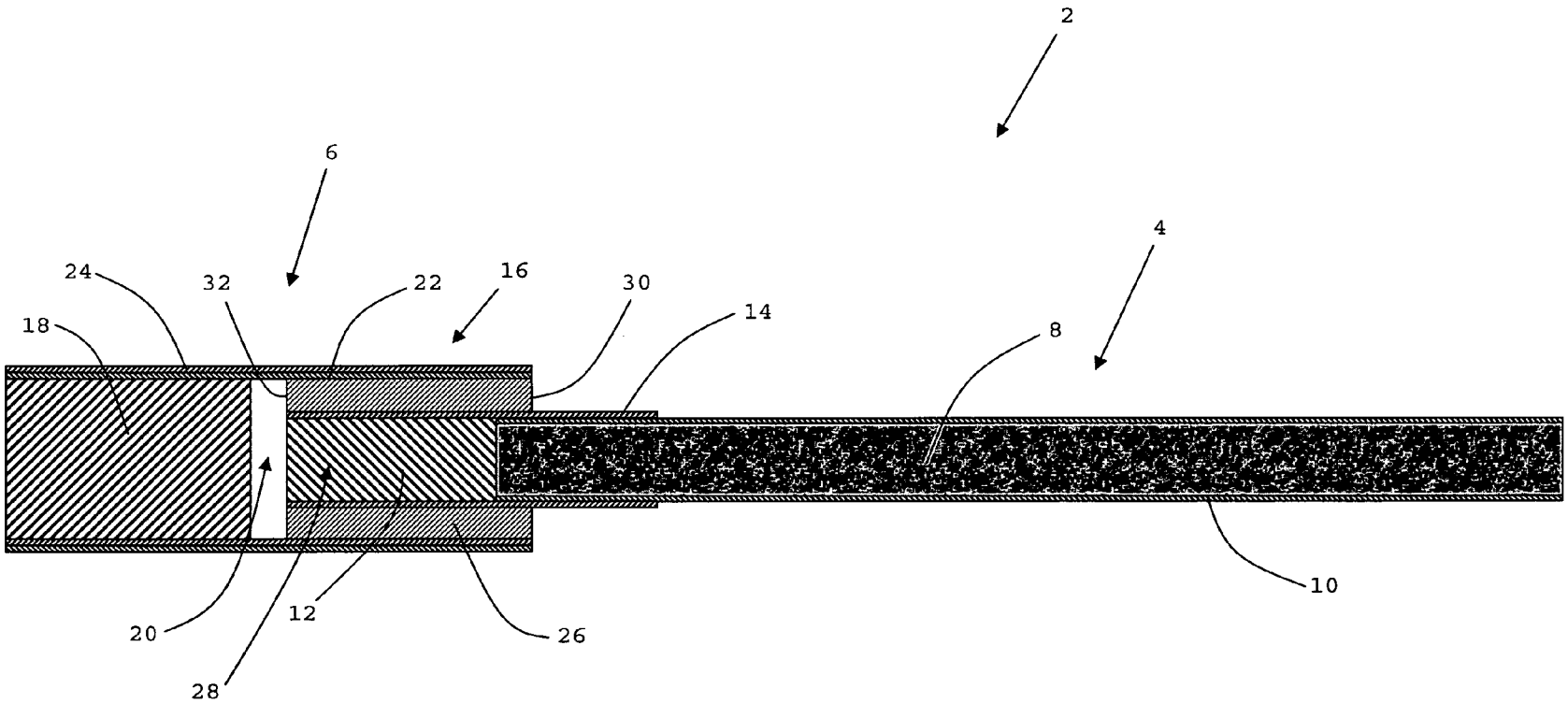
FIG. 1 shows a longitudinal cross-section through a cigarette according to a first embodiment of the invention.

FIG. 1 shows a first embodiment of a ventilated filter cigarette 2 having an overall length of 99 mm. The cigarette 2 comprises an elongate cylindrical rod 4 of circular cross-section and a coaxial cylindrical mouthpiece 6 of circular cross-section into which the mouth end of the rod 4 is inserted. The rod 4 is 82 mm in length and has an external diameter of 5.4 mm and the mouthpiece 6 is 32 mm in length. The rod 4 is inserted 15 mm into the mouthpiece so that 67 mm of the rod 4 extends outwardly from the rod end of the mouthpiece 6.

The rod 4 comprises a column of fine cut tobacco 8 wrapped in a porous cigarette paper 10 having an air permeability of 56 $cm^3/min.cm^2$ and a grammage of 25 $g/m^2$ and an axially aligned first filter plug 12. The wrapped tobacco column 8 is 70 mm in length and has a density of 245.5 $mg/cm^3$ and a RTD of 173 mm water gauge.

The first filter plug 12, which is formed of cellulose acetate having a total denier of 17000 and a denier per filament of 6.0, is 12 mm in length and has a RTD of 53 mm water gauge.

The wrapped column of fine cut tobacco 8 and the first filter plug 12 are held together in axial alignment by a band of air impermeable tipping paper 14 that circumscribes the mouth end of the rod 4. The band of air impermeable tipping paper 14, which has a thickness of 46 μm and a grammage of 37 $g/m^2$, is 24 mm in length and thus renders the entire outer surface of the first filter plug 12 and the outer surface of an adjacent 12 mm length of the wrapped tobacco column 8 air impermeable.

The mouthpiece 6 comprises a cylindrical, hollow, ventilation tube 16 of circular cross-section at the rod end thereof and an axially aligned cylindrical second filter plug 18 of circular cross-section at the mouth end thereof. The ventilation tube 16 and second filter plug 18, which are both 15 mm in length, are separated by a central mixing chamber 20 of 2 mm in length.

The outer surface of the mouthpiece 6 is rendered air impermeable by an inner wrapper 22 of rigid soft board, having a thickness of 50 μm and a grammage of 42 $g/m^2$, and an outer wrapper 24 of air impermeable tipping paper, having a thickness of 40 μm and a grammage of 35 $g/m^2$, which are wrapped around the periphery of the ventilation tube 16 and the second filter plug 18.

The second filter plug 18 is formed of cellulose acetate having a total denier of 42000 and a denier per filament of 2.6, and has a RTD of 75 mm water gauge. As shown in FIG. 1, the second filter plug 18 does not protrude from the mouth end of the mouthpiece 6.

The annular wall 26 of the ventilation tube 16, which has an external diameter of 7.9 mm, an internal diameter of 5.4 mm and a RTD of 44 mm water gauge, is inherently air permeable and encloses a central axial passage 28 into which the mouth end of the rod 4 is inserted. The rod 4 extends right through the axial passage 28 and is a friction fit therein. Retention of the rod 4 in the ventilation tube 16 and hence the mouthpiece 6 of the cigarette 2 may be ensured by additional means, such as a fine line of adhesive parallel to the axial passage 28.

The first 30 and second 32 annular end surfaces of the annular wall 26 of the ventilation tube 16, which are disposed around the rod 4, are both air permeable. The air permeable first annular end surface 30 is in fluid communication, through the annular wall 26 and the second annular end surface 32 of the ventilation tube 16, with the mixing chamber 20 of the mouthpiece 6 and thus provides an annular ventilation surface for the cigarette 2.

The air permeable annular wall 26 of the ventilation tube 16 is made from an inherently porous high density polyethylene (HDPE) obtainable from POREX® Porous Product Group, Germany. The HDPE has an average pore volume of 48.5%, an average pore size of 145 μm and a density of 0.5 $g/cm^3$.

When the cigarette 2 is smoked, ventilating air is drawn through the air permeable first annular end surface 30, through the air permeable annular wall 26 and through the air permeable second annular end surface 32 of the ventilation tube 16 and into the mixing chamber 20 where it mixes with mainstream smoke from the lit-end of the cigarette 2 drawn through the tobacco column 8 and the first filter plug 12. The air/smoke mixture then passes to the smoker's mouth through the second filter plug 18 at the mouth end of the mouthpiece 6.

Ventilating air drawn through the annular wall 26 of the ventilation tube 16 is prevented from entering the portion of the rod 4 extending through the passage 28 by the band of air impermeable tipping paper 14 circumscribing the mouth end of the rod 4. The ventilating air is thereby prevented from mixing with the mainstream smoke drawn through the rod 4 until it reaches the mixing chamber 20. As described above and shown in FIG. 1, the band of air impermeable tipping paper 14 also circumscribes 9 mm of the wrapped tobacco column 8 extending from the rod end of the mouthpiece 6 rendering it air impermeable. The band of air impermeable tipping paper 14 thereby advantageously also ensures that, in use, the cigarette 2 is not smoked beyond this point by the consumer and so prevents burning or smouldering of the mouthpiece 6.

Figure 2:
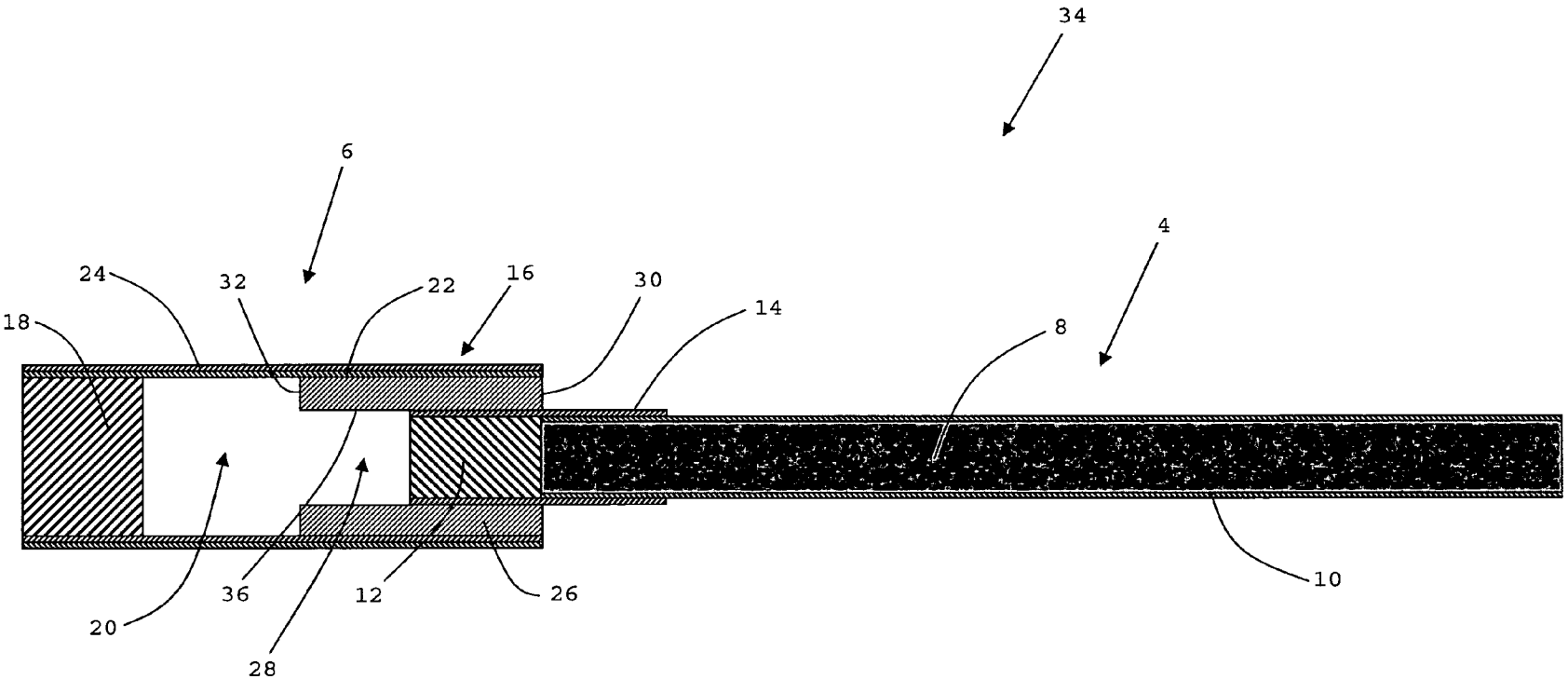
FIG. 2 shows a longitudinal cross-section through a cigarette according to a second embodiment of the invention.

FIG. 2 shows a second embodiment of a ventilated filter cigarette 34 having an overall length of 102 mm, which is of the same general construction as the cigarette 2 shown in FIG. 1.

The cigarette 34 shown in FIG. 2 differs from that of FIG. 1 in that the rod 4 does not extend through the whole length of the ventilation tube 16, which is made of heat treated cellulose acetate with a high plasticiser loading. Instead the rod 4, which is 78 mm in length, is only inserted 8 mm into the axial passage 28 of the ventilation tube 16 from the rod end thereof, leaving a 7 mm length of the passage 28, downstream of the rod 4 unoccupied.

The first filter plug 12 in this embodiment, which is formed of cellulose acetate having a total denier of 17000 and a denier per filament of 6.0, is shorter in length, 8 mm, and has a lower RTD, 35 mm water gauge, than the first filter plug 12 in the cigarette 2 of FIG. 1.

The band of air impermeable tipping paper 14 that circumscribes the mouth end of the rod 4 is 17 mm in length and thus renders the entire outer surface of the first filter plug 12, which is inserted into the axial passage 28, and the outer surface of an adjacent 9 mm length of the wrapped tobacco column 8, which extends outwardly from the rod end of the mouthpiece 6, air impermeable.

The second filter plug 18, which is formed of cellulose acetate having a total denier of 28000 and a denier per filament of 8.0, is also shorter in length, 7 mm, than in the cigarette 2 in FIG. 1 and has a RTD of only 7.8 mm water gauge. Finally, since the overall length of the mouthpiece 6 and the length of the ventilation tube 16 are the same as for the first embodiment, 32 mm and 15 mm respectively, the reduced length of the second filter plug 18 results in the mixing chamber 20 in this embodiment being longer, 10 mm, than in the first embodiment of FIG. 1.

When the cigarette 34 shown in FIG. 2 is smoked, ventilating air is drawn into the mixing chamber 20 as previously described above. In addition, ventilating air is drawn through the inner surface 36 of the annular wall 26 surrounding the central axial passage 28 into the space in the passage 28 not occupied by the rod 4. The space in the central axial passage 28 not occupied by the rod 4 thus acts as a second mixing chamber where the ventilating air mixes with mainstream smoke from the lit-end of the cigarette 34 drawn through the tobacco column 8 and the first filter plug 12. The air/smoke mixture then passes to the smoker's mouth through the second filter plug 18, which covers the mouth end of the mouthpiece 6, but has little filtration effect.

As in the first embodiment described above, the band of air impermeable tipping paper 14 circumscribing the mouth end of the rod 4 prevents lateral ingress of ventilating air from the annular wall 26 of the ventilation tube 16 into the portion of the rod 4 contained in the passage 28 and also prevents burning or smouldering of the mouthpiece 6.

Figure 3:
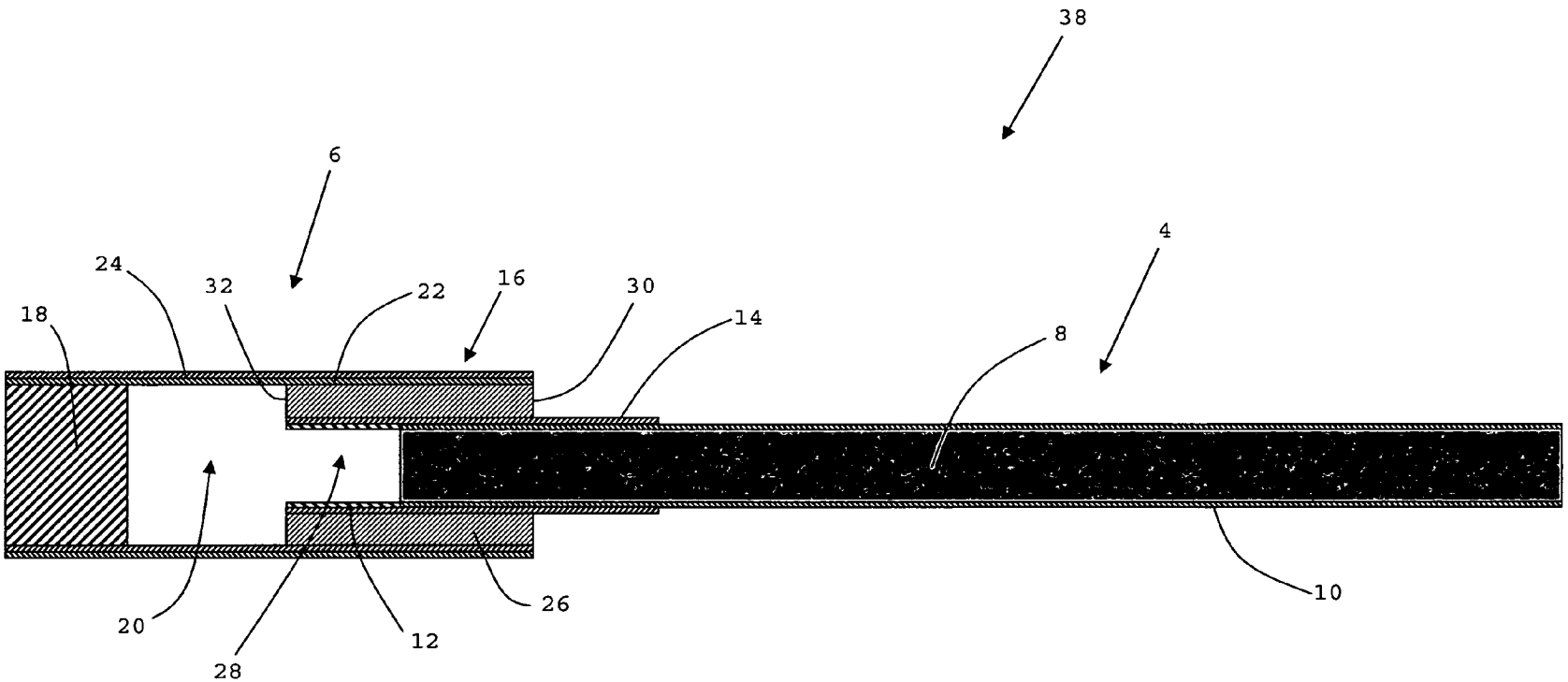
FIG. 3 shows a longitudinal cross-section through a cigarette according to a third embodiment of the invention.

FIG. 3 shows a third embodiment of a ventilated filter cigarette 38 having an overall length of 93 mm, which is also of the same general construction as the cigarette 2 shown in FIG. 1.

As shown in FIG. 3, the rod 4, which is 76 mm in length, extends through the whole length of the ventilation tube 16 of the cigarette 38. However, in this embodiment the first filter plug 12 at the mouth end of the rod 4 is replaced by an empty tube that is 6 mm in length.

The band of air impermeable tipping paper 14 that circumscribes the mouth end of the rod 4 is 24 mm in length and thus renders the entire outer surface of the empty tube 12 and the outer surface of an adjacent 18 mm length of the wrapped tobacco column 8 air impermeable; 9 mm of the length of wrapped tobacco column 8 is inserted into the axial passage 28 of the ventilation tube 16 and 9 mm extends outwardly from the rod end of the mouthpiece 6.

The overall length of the mouthpiece 6 and the length of the ventilation tube 16 in this embodiment are the same as for the first embodiment of FIG. 1, while the length of the mixing chamber 20 and the length and construction of the second filter plug 18 are the same as in the second embodiment of FIG. 2. The air permeable annular wall 26 of the ventilation tube 16, which has a high RTD of 301 mm water gauge, is made from an inherently porous high density polyethylene (HDPE) obtainable from POREX® Porous Product Group, Germany having an average pore volume of greater than 35%, an average pore size of 50-100 μm and a density of 0.4-0.5 $g/cm^3$.

When the cigarette 38 is smoked, ventilating air is drawn through the air permeable first annular end surface 30, through the air permeable annular wall 26 and through the air permeable second annular end surface 32 of the ventilation tube 16 and into the mixing chamber 20 where it mixes with mainstream smoke from the lit-end of the cigarette 38 drawn through the tobacco column 8 and the empty tube 12. The air/smoke mixture then passes to the smoker's mouth through the second filter plug 18, which covers the mouth end of the mouthpiece 6, but has little filtration effect.

In this embodiment, as in the first embodiment previously described above, the ventilating air drawn through the annular wall 26 of the ventilation tube 16 is prevented from entering the portion of the rod 4 extending through the axial passage 28 by the band of air impermeable tipping paper 14 circumscribing the mouth end of the rod 4, which also ensures that the cigarette 38 is extinguished before the mouthpiece 6 begins to burn or smoulder.

By varying the composition, length and RTD of the first filter plugs 12, second 18 filter plugs and annular walls 26 of the ventilation tubes 16 thereof, cigarettes according to the first, second and third embodiments of the invention shown in FIGS. 1, 2 and 3, comprising identical tobacco columns, but having different ventilation, deliveries and overall RTD, may be obtained. It will be appreciated that in each embodiment the composition, length and/or RTD of the filter plugs and annular wall of the ventilation tube may be varied independently of one another or in combination in order to achieve a cigarette having a particular ventilation, delivery and overall RTD. Smoking articles according to the present invention having desired overall RTDs, ventilation and deliveries may similarly be designed by varying one or more parameters of the components thereof in this manner.

For example, cigarettes 2 according to the first embodiment of the invention shown in FIG. 1 having about 83% ventilation, an overall RTD of about 102 mm water gauge and approximately 1 mg tar and 0.1 mg nicotine, cigarettes 34 according to the second embodiment of the invention shown in FIG. 2 having about 49% ventilation, an overall RTD of about 85 mm water gauge and approximately 6 mg tar and 0.5 mg nicotine and cigarettes 38 according to the third embodiment of the invention shown in FIG. 3 having about 40% ventilation, an overall RTD of about 85 mm water gauge and approximately 9 mg tar and 0.7 mg nicotine may all be produced using the wrapped tobacco column previously described.

To form the cigarettes shown in FIGS. 1, 2 and 3 the wrapped column of fine cut tobacco 8 and first filter plug 12 may be formed on a conventional rod maker and a conventional filter maker, respectively, and then assembled on a conventional cigarette maker with the over wrap of air impermeable tipping paper 14 to form the rod 4. The rod 4 may then be inserted into the rod end of a mouthpiece 6 pre-assembled using a conventional filter combiner. A known robot may be used to insert the formed rod 4 into the assembled mouthpiece 6, by seizing the rod, axially aligning it with the mouthpiece 6 and then inserting the required length of rod 4 into the rod end of the passage 28 of the ventilation tube 16.

The provision of an annular ventilation surface at a position on the smoking article remote from the smoker's mouth and fingers, and aligned substantially perpendicular to the principal axis of the smoking article, significantly reduces or eliminates the risk that the ventilation surface will be partly or wholly blocked by the smoker's mouth or fingers, thus ensuring that the intended level of ventilation is provided so that the smoking characteristics, including delivery, are those intended.

The invention claimed is:

1. A ventilated smoking article comprising:

a rod comprising a column of smokable material circumscribed by an air permeable wrapper; and a mouthpiece with an air impermeable outer wrapper and an air impermeable inner wrapper, the mouthpiece comprising:

a ventilation tube formed of air permeable, porous thermoplastic material, the ventilation tube substantially surrounded by the air impermeable outer wrapper and the air impermeable inner wrapper; and a mixing chamber downstream of the ventilation tube, the ventilation tube having an annular air permeable wall that defines a passage in which an end portion of the rod is received, the rod extending from a rod end of the ventilation tube, and wherein an end surface of the annular wall at the rod end of the ventilation tube extends outward from the rod and being in fluid communication with the mixing chamber, wherein the interface between the annular wall of the ventilation tube and the outer surface of the end portion of the rod received in the passage is air impermeable, wherein the rod further comprises a filter element downstream of the column of smokable material wherein the filter element and the column of smokable material are joined by a band of air impermeable material, in which the band of air impermeable material circumscribes the end portion of the rod received in the passage and a portion of the rod extending from the rod end of the ventilation tube adjacent thereto.

2. A smoking article according to claim 1 wherein the rod and the ventilation tube are substantially circular in cross-section.

3. A smoking article according to claim 1 wherein the rod extends through the entire length of the passage in the ventilation tube.

4. A smoking article according to claim 1 wherein the rod extends partially through the length of the passage in the ventilation tube.

5. A smoking article according to claim 1 in which the outer surface of the end portion of the rod received in the passage is air impermeable.

6. A smoking article according to claim 5 in which the outer surface of a portion of the rod extending from the rod end of the ventilation tube, adjacent to the mouthpiece, is air impermeable.

7. A smoking article according to claim 1 in which the mouthpiece further comprises a filter element downstream of the mixing chamber.

8. A smoking article according to claim 1 in which the rod comprises a column of tobacco wrapped in cigarette paper.

9. A smoking article according to claim 1 wherein the porous thermoplastic material is a polyolefin.

10. A smoking article according to claim 1, wherein the end surface of the annular air permeable wall ensures that, in use, the smoking article is not smoked beyond the end surface of the annular air permeable wall by a consumer and prevents burning or smouldering of the mouthpiece.

11. A ventilated smoking article comprising:

a rod comprising a column of smokable material circumscribed by an air permeable wrapper; and a mouthpiece with an air impermeable outer wrapper, the mouthpiece comprising:

a ventilation tube formed of air permeable, porous thermoplastic material, the ventilation tube substantially surrounded by the air impermeable outer wrapper; and a mixing chamber downstream of the ventilation tube, the ventilation tube having an annular air permeable wall that defines a passage in which an end portion of the rod is received, the rod extending from a rod end of the ventilation tube, and wherein an end surface of the annular wall at the rod end of the ventilation tube extends outward from the rod and being in fluid communication with the mixing chamber, wherein the interface between the annular wall of the ventilation tube and the outer surface of the end portion of the rod received in the passage is air impermeable, wherein the interface between the annular wall of the ventilation tube and the outer surface of the end portion of the rod received in the passage is air impermeable, wherein the rod further comprises a filter element downstream of the column of smokable material wherein the filter element and the column of smokable material are joined by a band of air impermeable material, in which the band of air impermeable material circumscribes the end portion of the rod received in the passage and a portion of the rod extending from the rod end of the ventilation tube adjacent thereto.

12. A smoking article according to claim 11 wherein the rod and the ventilation tube are substantially circular in cross-section.

13. A smoking article according to claim 11 in which the outer surface of the end portion of the rod received in the passage is air impermeable.

14. A smoking article according to claim 13 in which the outer surface of a portion of the rod extending from the rod end of the ventilation tube, adjacent to the mouthpiece, is air impermeable.

* * * * *